US009028265B2

(12) United States Patent
Aoki et al.

(10) Patent No.: US 9,028,265 B2
(45) Date of Patent: May 12, 2015

(54) LEVER MECHANISM FOR CONNECTOR FITTING, AND CONNECTOR

(75) Inventors: Hiroshi Aoki, Toyota (JP); Osamu Oshita, Toyota (JP); Naoki Kobayashi, Toyota (JP); Hiroshi Kobayashi, Toyota (JP); Masao Nagano, Toyota (JP); Akihiro Tsuruta, Fujieda (JP); Tetsuya Hayashi, Toyota (JP)

(73) Assignee: Yazaki Corporation, Tokyo (JP)

( * ) Notice: Subject to any disclaimer, the term of this patent is extended or adjusted under 35 U.S.C. 154(b) by 22 days.

(21) Appl. No.: 14/124,909

(22) PCT Filed: Jun. 14, 2012

(86) PCT No.: PCT/JP2012/065291

§ 371 (c)(1),
(2), (4) Date: Dec. 9, 2013

(87) PCT Pub. No.: WO2012/173212

PCT Pub. Date: Dec. 20, 2012

(65) Prior Publication Data

US 2014/0113480 A1 Apr. 24, 2014

(30) Foreign Application Priority Data

Jun. 17, 2011 (JP) ..... 2011-134973

(51) Int. Cl.
*H01R 13/629* (2006.01)

(52) U.S. Cl.
CPC .... *H01R 13/62977* (2013.01); *H01R 13/62933* (2013.01)

(58) Field of Classification Search
CPC ..... H01R 13/62938; H01R 13/62933
USPC ..... 439/157, 372
See application file for complete search history.

(56) References Cited

U.S. PATENT DOCUMENTS

| | | | | |
|---|---|---|---|---|
| 7,976,322 | B2 * | 7/2011 | Matsumura et al. | 439/153 |
| 2009/0203240 | A1 | 8/2009 | Matsumura et al. | |

FOREIGN PATENT DOCUMENTS

| | | | |
|---|---|---|---|
| JP | 50-32431 | B1 | 10/1975 |
| JP | 1-88474 | U | 6/1989 |
| JP | 2002-25696 | A | 1/2002 |
| JP | 2009-187863 | A | 8/2009 |
| JP | 2011-150934 | A | 8/2011 |

OTHER PUBLICATIONS

International Search Report dated Aug. 28, 2012 issued in International Application No. PCT/JP2012/065291 (PCT/ISA/210).

(Continued)

*Primary Examiner* — Abdullah Riyami
*Assistant Examiner* — Thang Nguyen
(74) *Attorney, Agent, or Firm* — Sughrue Mion, PLLC

(57) ABSTRACT

A lever mechanism for connector fitting 1 includes a hold part 2 for holding a connector housing 4, and a handle part 3. When the handle part 3 is rotated and the connector housing 4 is thereby inserted into the connector housing 5, an engaging projection 24 is caused to retreat from the inner surface of a side plate 21 toward the connector housing 4, thereby removing the holding of the connector housing 4 by the hold part 2.

5 Claims, 10 Drawing Sheets

(56) References Cited

OTHER PUBLICATIONS

Written Opinion dated Aug. 28, 2012 issued in International Application No. PCT/JP2012/065291 (PCT/ISA/237).

Written Opinion dated Aug. 28, 2012 issued by the International Searching Authority in corresponding International Application No. PCT/JP2012/065291 (PCT/ISA/237).

* cited by examiner

LEVER MECHANISM FOR CONNECTOR FITTING, AND CONNECTOR

TECHNICAL FIELD

The present invention relates to a lever mechanism for connector fitting which is used to fit a male connector and a female connector with each other, and a connector in which a male connector and a female connector can be fitted with each other by such lever mechanism for connector fitting.

BACKGROUND ART

FIG. 11 is a plan view of a conventional lever-fit type connector. As shown in FIG. 11, a lever-fit type connector 210 is a connector in which a male connector 202 can be fitted with a female connector 203 with a low insertion force by rotating a lever 201 mounted on the male connector 202. The lever 201 includes a temporarily engaging piece 213 which, in the early stage of the fitting of the connectors, can be engaged with the male connector 202 to thereby prevent the lever 201 against rotation toward the female connector 203. Also, the female connector 203 includes a removing plate portion for removing the engagement of the temporarily engaging piece 213 with the male connector 202 (see the patent document 1).

PRIOR ART TECHNOLOGY DOCUMENT

Patent Document

Patent Document 1: Japanese Patent Publication No. 2009-187863

DISCLOSURE OF THE INVENTION

Problems that the Invention is to Solve

However, the above-mentioned conventional lever-fit type connector 210 has the following problem. That is, in the lever-fit type connector 210, even after the fitting of the male connector 202 and female connector 203 is completed, the lever 201 remains mounted on the male connector 202. Thus, even after completion of the fitting, the weight of a vehicle carrying the lever-fit type connector 210 is not reduced.

Therefore, it is an object of the invention to provide a lever mechanism for connector fitting which, after a first connector and a second connector are fitted with each other, is automatically removed from the first and second connectors, and a connector including a first connector and a second connector which can be fitted with each other by such lever mechanism for connector fitting.

In order to achieve the above mentioned object, a lever mechanism for connector fitting according to an embodiment of the invention has the below characteristics (1) and (2).

(1) A lever mechanism for connector fitting for connecting together a first connector having a first connector housing and a second connector having a second connector housing, comprising:

a hold part for holding the second connector housing; and, a handle part mounted rotatably on the hold part and catchable on the first connector housing, wherein the hold part includes a pair of side plates for positioning the second connector housing between them, a pressure plate extended from a portion of one of the paired side plates toward the other side plate, and at least one engaging projection provided on an inner surface of one of the side plates so as to be able to advance from such inner surface toward the other side plate and retreat from the other side plate to such inner surface, the engaging projection being used to position a portion of the second connector housing between the pressure plate and the engaging projection itself, whereby, when the handle part is rotated to thereby insert the second connector housing into the first connector housing, the engaging projection retreats from the second connector housing, thereby removing the holding of the second connector housing by the hold part.

(2) A lever mechanism for connector fitting according to the above described (1), wherein at least one of the side plates of the hold part and the handle part includes a recessed portion or a penetration hole, and the other includes a temporarily engaging projection engageable into the recessed portion or the penetration hole.

In order to achieve the above mentioned object, a lever according to an embodiment of the invention has the below characteristics (3) and (4).

(3) A connector, comprising: a first connector having a first connector housing; and, a second connector having a second connector housing, the connector being structured such that the second connector housing is inserted into the first connecting housing by the lever mechanism for connector fitting according to the above described (1) or (2) to thereby fit the first connector and the second connector with each other, wherein the first connector housing includes a first housing main body having an opening and a cylindrical projecting portion provided on an outer surface of the first housing main body and capable of catching the handle part of the lever mechanism for connector fitting, and the second connector housing includes a second cuboid-shaped housing main body and a pair of flange portions respectively projected from a pair of mutually opposed side surfaces of the second housing main body, whereby, in a state where the second connector housing is inserted into the first connector housing, the flange portions of the second connector housing are contacted with an edge portion of the first connector housing as constitutes an opening of the first connector housing.

(4) A connector, comprising: a first connector having a first connector housing; and, a second connector having a second connector housing, the connector being structured such that the second connector housing is inserted into the first connecting housing by the lever mechanism for connector fitting according to the above mentioned (2) to thereby fit the first connector and the second connector with each other, wherein the first connector housing includes a first housing main body having an opening and a cylindrical projecting portion provided on an outer surface of the first housing main body and capable of catching the handle part of the lever mechanism for connector fitting, and the second connector housing includes a second cuboid-shaped housing main body and a pair of flange portions respectively projected from a pair of mutually opposed side surfaces of the second housing main body, whereby, in a state where the second connector housing is inserted into the first connector housing, the flange portions of the second connector housing are contacted with an edge portion of the first connector housing as constitutes an opening of the first housing main body, and wherein the first housing main body includes on the outer surface thereof a temporary engagement removing rib extending in the fitting direction of the first connector and the second connector, whereby, when the temporary engagement removing rib advances into between the hold part and the handle part, the engagement between the recessed portion or the penetration hole and the temporarily engaging projection can be removed.

Means for Solving the Problems

According to a lever mechanism for connector fitting having the structure disclosed in the above item (1), it includes a hold part for holding the second connector housing and a handle part mounted rotatably on the hold part and catchable on the first connector housing. And, the hold part includes a pair of side plates for positioning the second connector housing between them, a pressure plate extended from a portion of one of the paired side plates toward the other side plate, and at least one engaging projection provided on the inner surface of one of the side plates so as to be able to advance from such inner surface toward the other side plate and retreat from the other side plate for positioning a portion of the second connector housing between the pressure plate and itself. When the handle part is rotated and the second connector housing is thereby inserted into the first connector housing, the engaging projection retreats from the second connector housing to thereby remove the holding of the second connector housing by the hold part. Thus, it is possible to provide the lever mechanism for connector housing which, after the first and second connectors are fitted with each other, is automatically removed from the first and second connectors.

According to the lever mechanism for connector fitting having the structure disclosed in the above item (2), at least one of the side plates of the hold part and the handle part includes a recessed portion or a penetration hole, and the other includes a temporarily engaging projection engageable into the recessed portion or the penetration hole. This makes it possible to restrict the position of the handle part in the start time of the connector fitting operation, thereby being able to facilitate the connector fitting operation.

According to the connector having the structure disclosed in the above item (3), it includes the first connector having the first connector housing and the second connector having the second connector housing. The second connector housing includes the second cuboid-shaped housing main body and the paired flange portions respectively projected from a pair of mutually opposed side surfaces of the second housing main body. Also, the first connector housing includes the first housing main body having an opening and a cylindrical projecting portion provided on the outer surface of the first housing main body and capable of catching the handle part of the lever mechanism for connector fitting. In a state where the second connector housing is inserted into the first connector housing, the flange portions of the second connector housing are contacted with the edge portion of the first connector housing constituting the opening thereof. Thus, it is possible to provide an inexpensive and lightweight connector in which, after the first and second are fitted with each other, the lever mechanism for connector fitting is automatically removed.

According to a connector having the structure disclosed in the above item (4), the first housing main body includes on its outer surface a temporary engagement removing rib extending in the fitting direction of the first and second connectors and, when the temporary engagement removing rib advances into between the side plates of the hold part and the handle part, the engagement between the recessed portion or the penetration hole and the temporarily engaging projection can be removed. Therefore, when a portion of the second connector with the lever mechanism for connector fitting mounted thereon is inserted into the first connector, the engagement between the recessed portion or penetration hole and the temporarily engaging projection can be removed, which can facilitate the connector fitting operation.

MODE FOR CARRYING OUT THE INVENTION

Now, description is given below of a lever mechanism for connector fitting according to an embodiment of the invention with reference to FIGS. 1 to 10.

Figure 1:
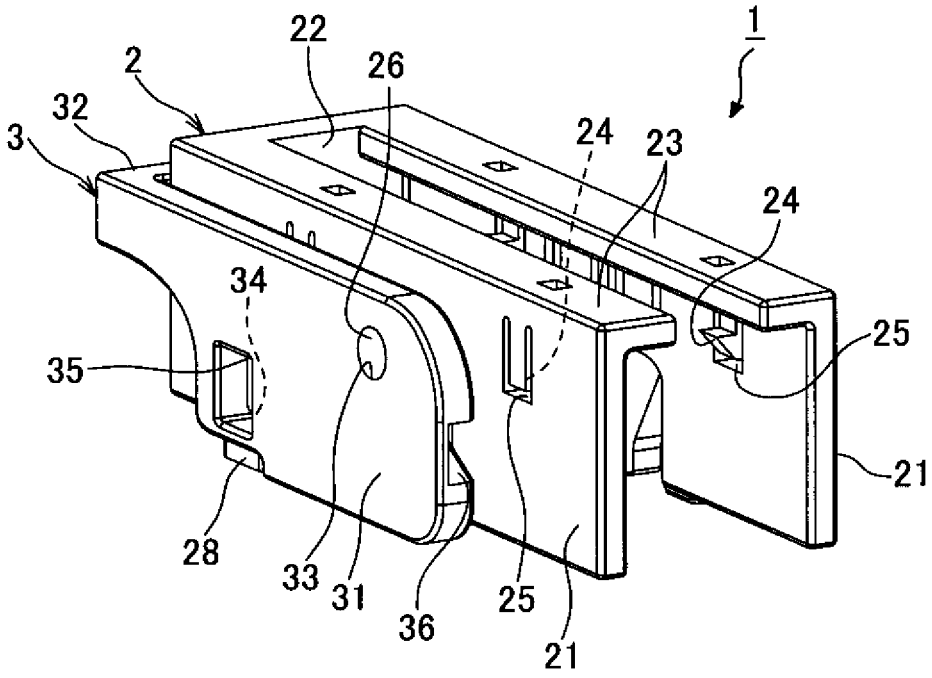
FIG. 1 is a perspective view of a lever mechanism for connector fitting according to an embodiment of the invention.

As shown in FIG. 1, a lever mechanism for connector fitting 1 according to an embodiment of the invention is used to fit a first connector 15 (see FIG. 4) having a female-type connector housing 5 serving as a first housing and a second connector 14 (see FIG. 3) having a male-type connector housing 4 serving as a second housing with each other with a low insertion force. Also, a connector 10 according to an embodiment of the invention constitutes a wire harness used in a car, and includes the first connector 15 and second connector 14.

Firstly, description is given of the structures of the first connector 15 and second connector 14.

Figure 3:
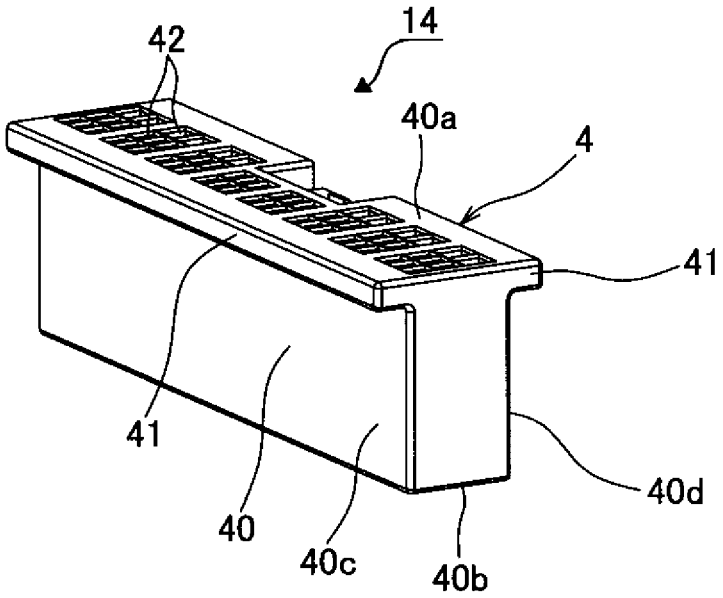
FIG. 3 is a perspective view of a second connector constituting a connector according to the embodiment of the invention.

As shown in FIG. 3, the second connector 14 includes a male-type connector housing 4 and multiple female-type terminal metal members (not shown) stored within the connector housing 4. The connector housing 4 is made of synthetic resin and includes a cuboid-shaped housing main body 40 serving as a second housing main body and flange portions 41 respectively projected from a pair of mutually opposed side surfaces 40*c* and 40*d* of the housing main body 40. The housing main body 40 includes multiple cavities 42 for storing the above-mentioned terminal metal members. The cavities 42 are respectively opened in the upper surface 40*a* and lower surface 40*b* of the housing main body 40. Also, although electric wires connected to the terminal metal members are respectively drawn out from the upper surface 40*a* side openings of the cavities 42, the illustration thereof is omitted. Also, the paired flange portions 41 are respectively projected from the upper ends (which are situated near to the upper surface 40*a*) of the side surfaces 40*c* and 40*d*.

Here, in this embodiment, although the flange portions 41 are respectively projected from the mutually opposed paired side surfaces 40*c* and 40*d* of the housing main body 40, the flange portions 41 need only be projected from the mutually opposed paired side surfaces. For example, the flange portions 41 may also be projected only from one of the side surfaces.

Figure 4:
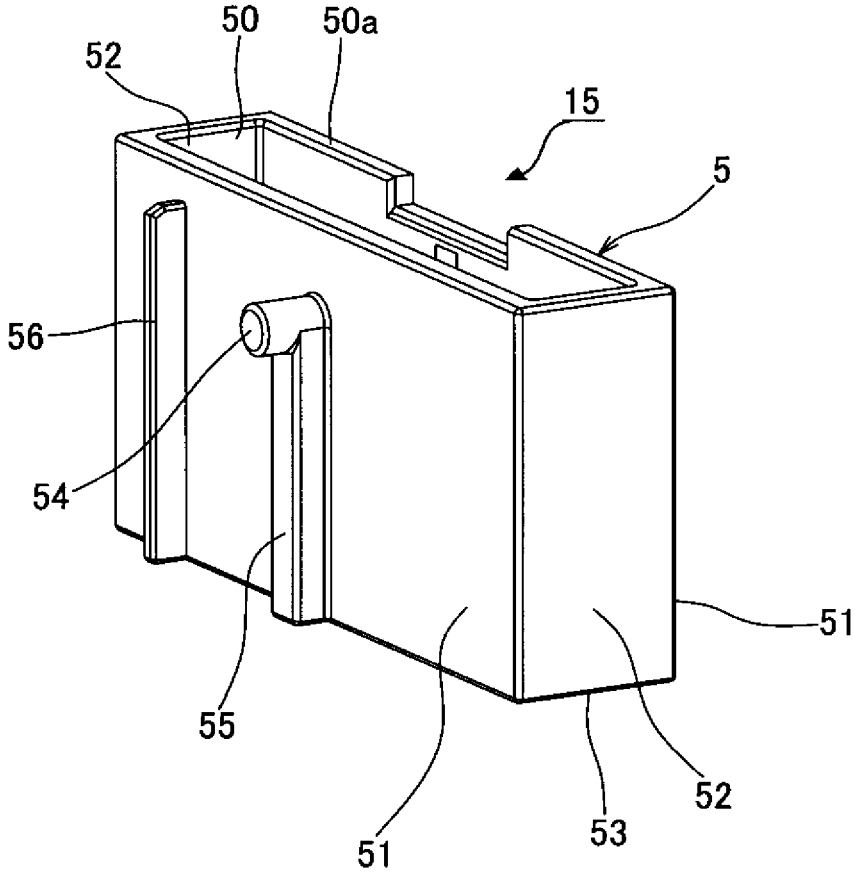
FIG. 4 is a perspective view of a first connector constituting the connector according to the embodiment of the invention.

As shown in FIG. 4, the first connector 15 includes the female-type connector housing 5 and multiple male-type terminal metal members (not shown) respectively stored within the connector housing 5. The connector housing 5 includes a first housing main body having an opening 50 (the first housing main body is hereinafter also called the connector housing 5). The connector housing 5 is made of synthetic resin and includes a rectangular bottom wall 53 and four side walls 51, 52 respectively erected from the outer edges of the bottom wall 53 (one pair of mutually opposed side walls are designated by reference numeral 51, whereas the other pair of mutually opposed side walls are designated by reference numeral 52). Thus, the connector housing 5 is formed in a box shape in which the opening 50 is formed on the side thereof opposed to the bottom wall 53. The terminal metal members are held on the bottom wall 53.

Also, the paired side walls 51 respectively include, on their outer surfaces, cylindrical projecting portions 54 capable of catching the handle part 3 of the lever mechanism for connector fitting 1 (which will be discussed later), ribs 55 extending linearly from the lower portions of the projecting portions 54 toward the bottom side 53, and temporary engagement removing ribs 56 extending in the fitting direction of the first connector 15 and second connector 14. The functions of the projecting portions 54 and temporary engagement removing ribs 56 are discussed later.

Figure 10:
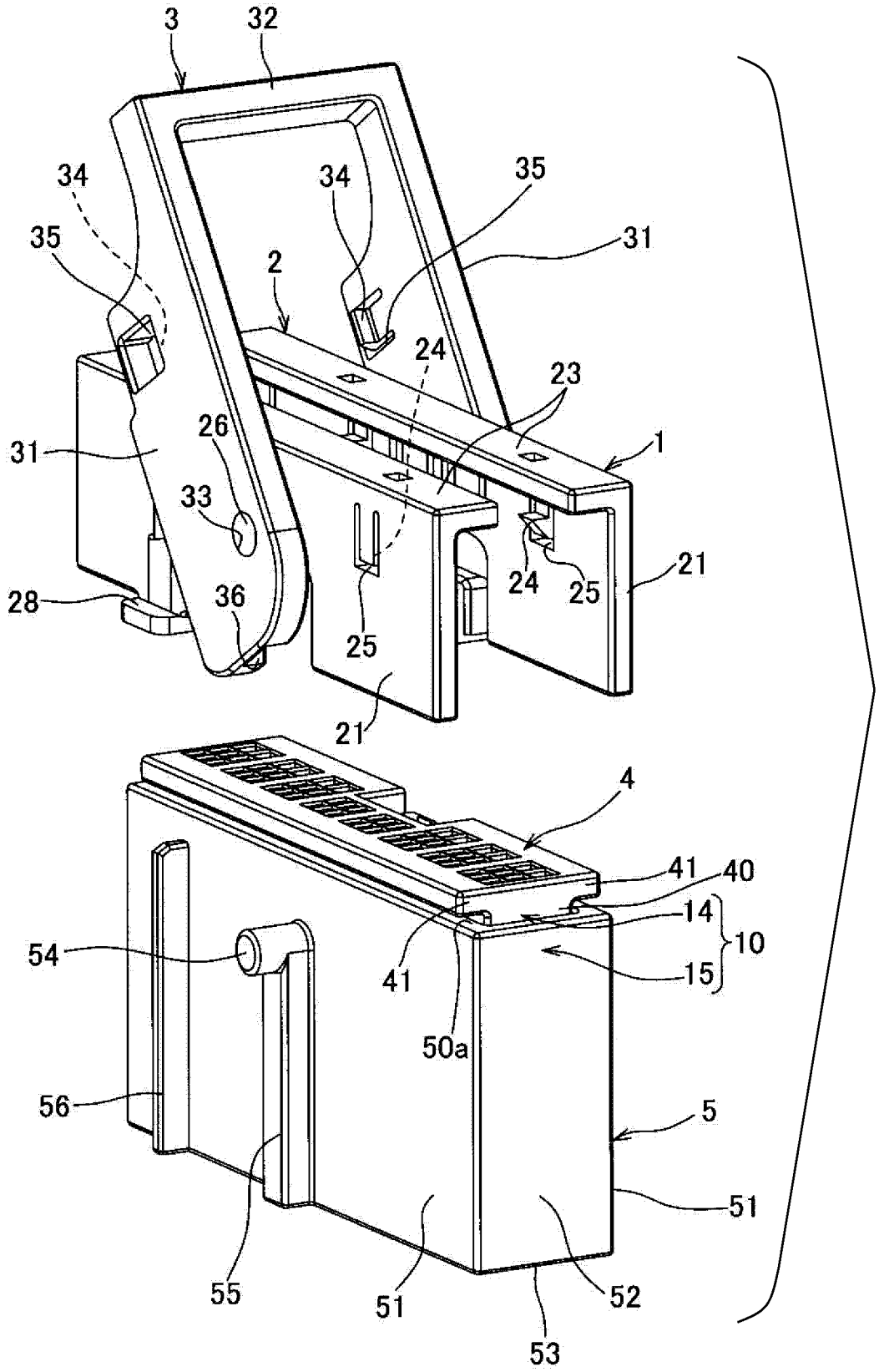
FIG. 10 is an explanatory view to explain a connector fitting method using the lever mechanism for connector fitting shown in FIG. 1, showing a state where the lever mechanism for connector fitting is removed from the second connector fitted with the first connector.
Figure 11:
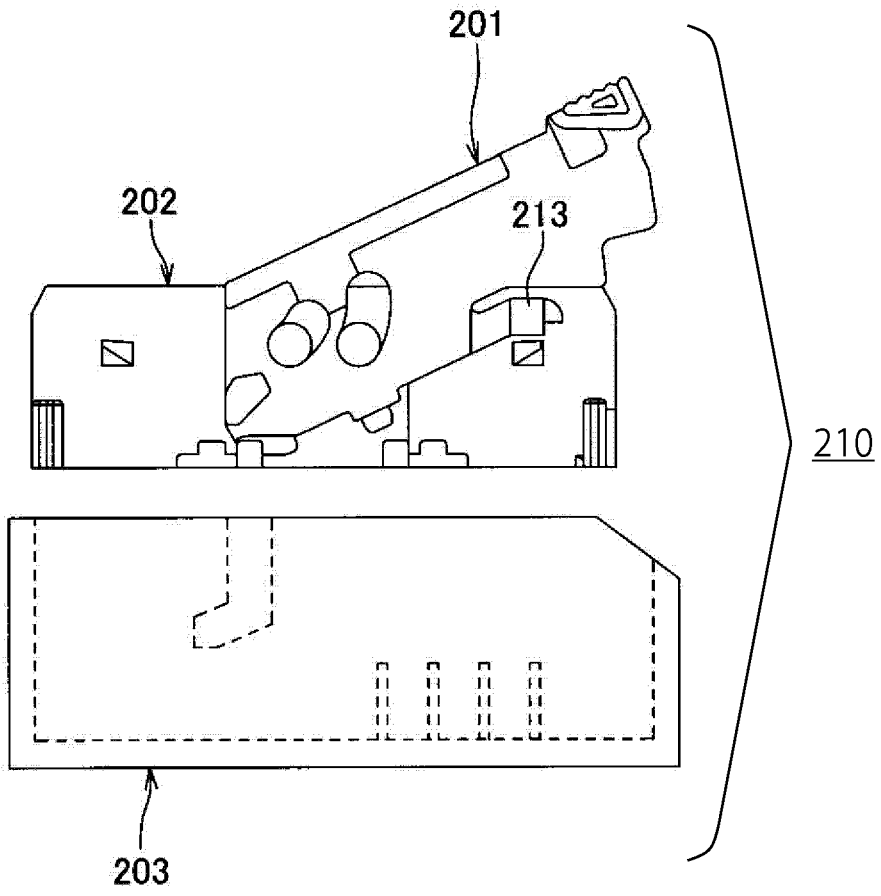
FIG. 11 is a plan view of a conventional lever-fit type connector.

The above-mentioned first connector 15 and second connector 14 are fitted with each other in such a manner that, as shown in FIG. 10, the housing main body 40 of the male-type connector housing 4 is inserted into the female-type connector housing 5 and the male-type terminal metal members of the first connector 15 are inserted into the female-type terminal metal members of the second connector 14. Also, the paired flange portions 41 of the male-type connector housing 4, in the connectors fitted state, are put on the edge portions 50*a* (constituting the opening 50) of the female-type connector housing 5. That is, in a state where the connector housing 5 is inserted into the connector housing 4, the flange portions 41 of the connector housing 5 are contacted with the edge portions 50*a* (constituting the opening 50) of the connector housing 4.

Next, description is given of the structure of the lever mechanism for connector fitting 1.

Figure 2:
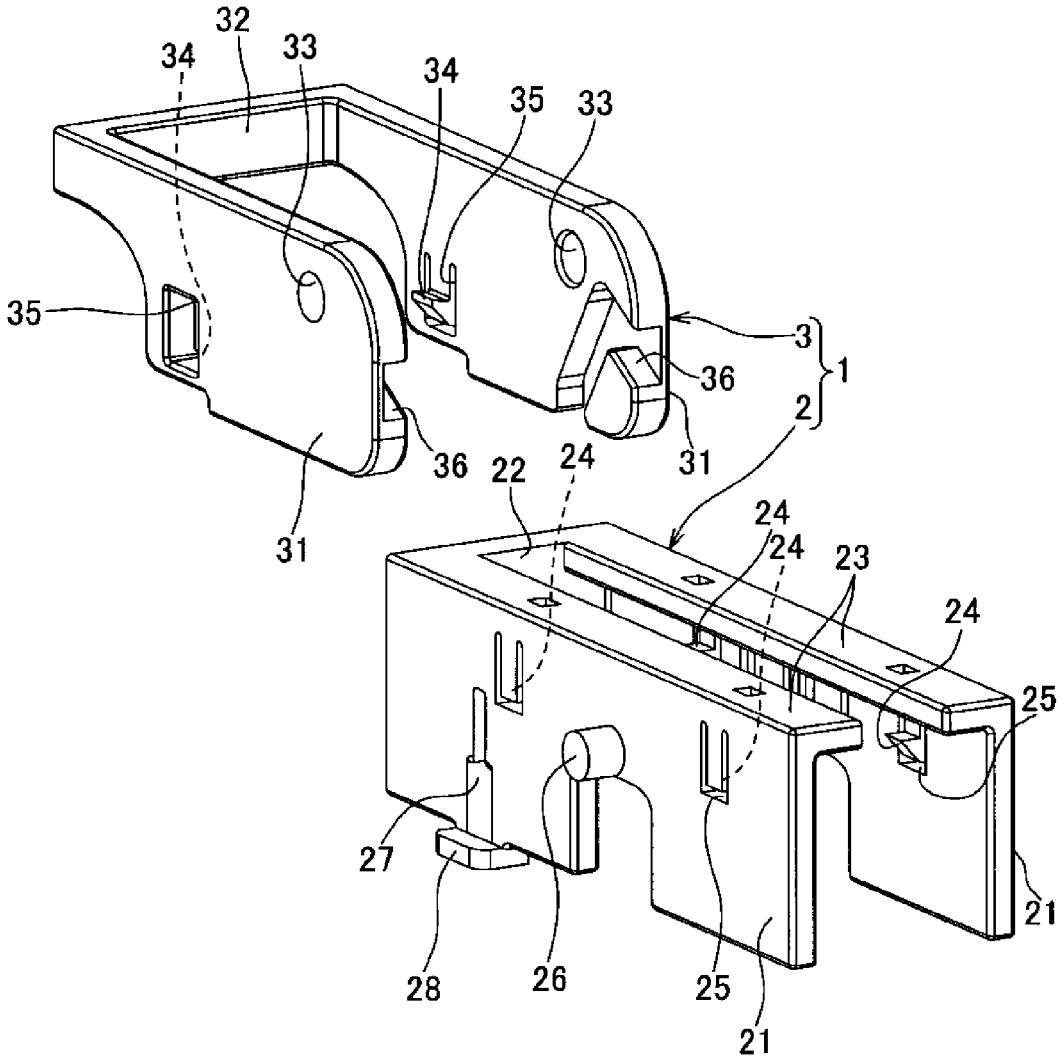
FIG. 2 is an exploded perspective view of the lever mechanism for connector fitting shown in FIG. 1.

As shown in FIG. 2, the lever mechanism for connector fitting 1 includes two parts, that is, a hold part 2 for holding the male-type connector housing 4 and a handle part 3 mounted rotatably on the hold part 2 and catchable on the female-type connector housing 5. The hold part 2 and handle part 3 are made of synthetic resin.

Figure 6:
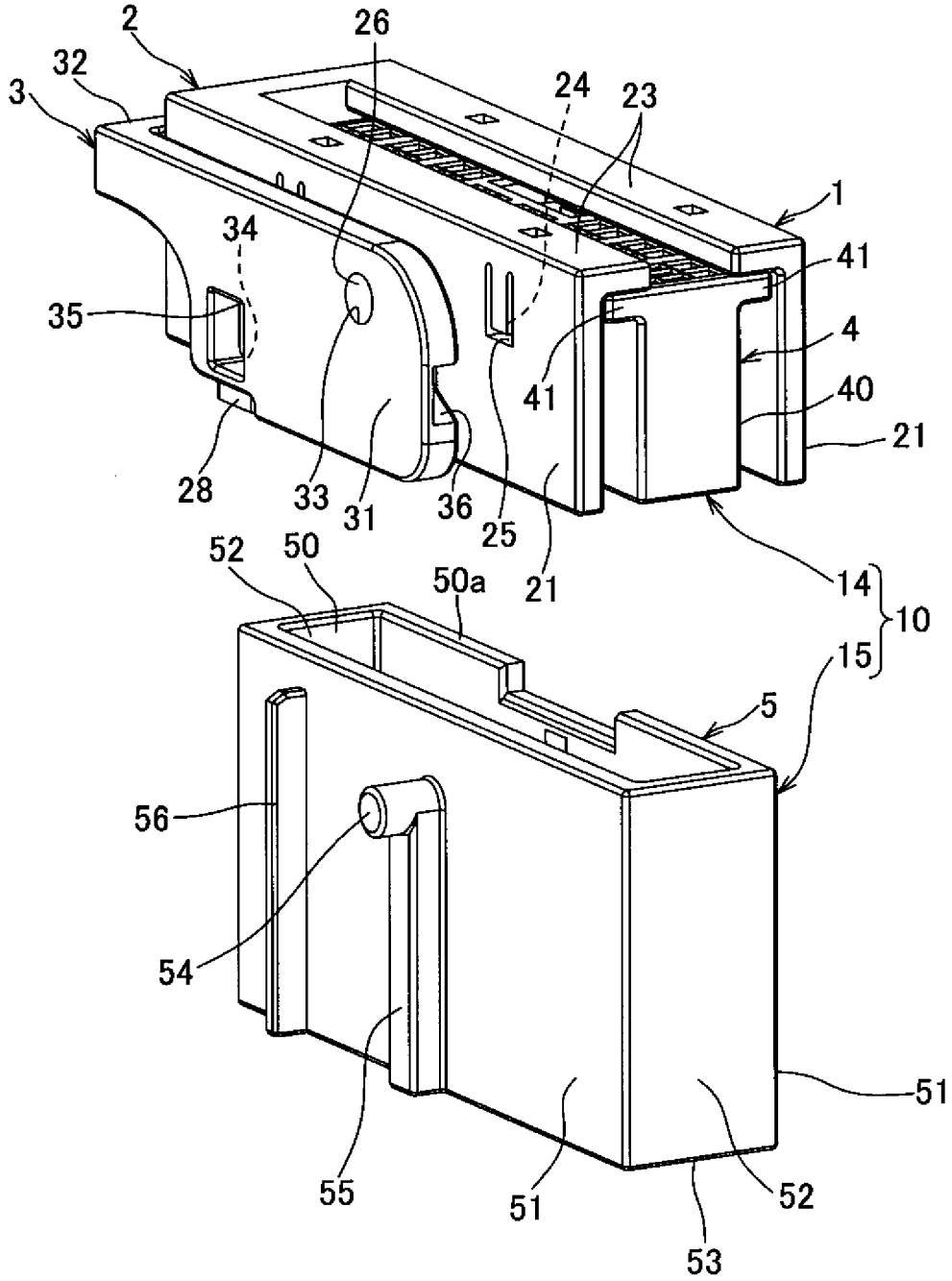
FIG. 6 is an explanatory view to explain a connector fitting method using the lever mechanism for connector fitting shown in FIG. 1, showing a state where the second connector shown in FIG. 5 is mounted on the lever mechanism for connector fitting.

The hold part 2 includes a pair of side plates 21 for positioning the male-type connector housing 4 between them, pressure plates 23 respectively extended from the upper ends, that is, the one-side ends (constituting part) of the paired side plates 21 in a direction where they approach each other, a second side plate 22 connecting together the longitudinal-direction one-side ends of the side plates 21, and multiple engaging projections 24 respectively provided on and projected from the inner surfaces of the side plates 21. In this embodiment, two engaging projections 24 are provided on each side plate 21, whereby a total of four engaging projections 24 are provided. Each engaging projection 24 has a section of a triangular shape. Also, in the side plates 21, there are formed U-shaped cuts 25 in such a manner that they surround their associated engaging projections 24. Thus, the engaging projections 24 are allowed to advance from the inner surface of one of the paired side plates 21 toward the other side plate 21 disposed opposed to the one side plate 21, that is, toward the male-type connector housing 4, and retreat from the connector housing 4. The thus-structured hold part 2, as shown in FIG. 6, positions the paired flange portions 41 serving as part of the male-type connector housing 14 between the multiple engaging projections 24 and the paired pressure plates 23, thereby holding the male-type connector housing 4.

Here, in this embodiment, the pressure plates 23 are structured such that they extend from the respective upper ends of the paired side plates 21 in the directions where they approach each other. However, essentially, the pressure plates 23 only need to extend from a portion of one of the paired side plates 21 toward the other side plate 21. For example, only on one side plate 21, there may be provided the pressure plate 23 that extends toward the other side plate 21.

Also, similarly, in this embodiment, the engaging projections 24 are provided on the respective inner surfaces of the paired side plates 21. However, essentially, the engaging projection 24 may only be provided on the inner surface of one of the paired side plates 21 in such a manner that it can advance from the inner surface of one side plate 21 toward the other side plate 21 and retreat from the other side plate 21. For example, the engaging projection 24 may be provided only on the inner surface of one side plate 21 in such a manner that it can advance from such inner surface toward the other side plate 21 and retreat from the other side plate 21.

Also, when the pressure plate 23 and engaging projection 24 are respectively provided only on one of the side plates 21, the side plate 21 for forming the engaging projection 24 and the side plate 21 for forming the pressure plate 23 may be different from each other or may be the same plate.

Further, the hold part 2 includes on each of the side plates 21*a* pair of mounting projecting portions 26 for mounting the handle part 3 rotatably, and a penetration hole 27 and a contact plate 28 cooperating together to restrict the position of the handle part 3 in such a manner that the handle part 3 is prevented against movement in other operations than the connector fitting operation. The paired mounting projecting portions 26 project in a cylindrical shape from the outer surfaces of their associated side plates 21. The penetration holes 27 are formed in their associated side plates 21 so as to penetrate therethrough. Or, instead of the penetration holes 27, the hold part 2 may also have recessed portions which are formed recessed from the outer surfaces of the side plates 21. The contact plates 28 are respectively disposed on the lower ends of the side plates 21 and in the vicinity of the penetration holes 27.

The handle part 3 includes a pair of plate portions 31 for positioning the paired side plates 21 between them, a connecting portion 32 for connecting together the longitudinal-direction one-side ends of the paired plate portions 31, and a pair of temporarily engaging projections 34 to be engaged into the penetration holes 27. The temporarily engaging projections 34 respectively project from the inner surfaces of their associated plate portions 31, and each projection 34 has a section of a triangular shape. Also, each plate portion 31 has a U-shaped cutout 35 so as to surround its associated temporarily engaging projection 34. Due to this, each temporarily engaging projection 34 is allowed to advance from the inner surface of the plate portion 31 toward the side plate 21 and retreat from such side plate 21. In the case that the temporarily engaging projections 34 are engaged into the penetration holes 27, the handle part 3 is prevented against movement in other operations than in the connector fitting operation. Also, as shown in FIG. 1, with the temporarily engaging projections 34 engaged into the penetration holes 27, the plate portions 31 are contacted with the contact plate 28. Thus, the handle part 3 is prevented from moving downwardly of the contact plate 28.

Here, according to the structure of this embodiment, the penetration holes 27 are formed in the side plates 21 of the hold part 2 and the temporarily engaging projections 34 are provided on the handle part 3. However, so long as the penetration holes 27 are formed in any one of the side plates 21 of the hold part 2 and the handle part 3 and the temporarily engaging projections 34 to be engaged into their associated penetration holes 27 are provided in the other, the penetration holes 27 may be formed in the handle part 3 and the temporarily engaging projections 34 to be engaged into the penetration holes 27 may be provided on the side plates 21 of the hold part 2. This applies similarly to the recessed portions that can be formed instead of the penetration holes 27, that is, the recessed portions may be formed in the handle part 3 and the temporarily engaging projections to be engaged into such recessed portions may be provided on the side plates 21 of the hold part 2.

Also, the paired plate portions 31 respectively include mounting hole portions 33 for positioning the paired mounting projecting portions 26 therein, and catch grooves 36 for positioning the above-mentioned projecting portions 54 movably. The mounting hole portions 33 are formed in the other ends of the plate portions 31 in the longitudinal direction. The catch grooves 36 are respectively formed such that they are recessed from the inner surfaces of the plate portions 31. The one-side end portions and other end portions of the catch grooves 36 are respectively open in the outer edges of the plate portions 31. When the handle part 3 is rotated relative to the hold part 2, the projecting portions 54 are caused to advance into the catch grooves 36 from the one-side end portions of the catch grooves 36 and move out of the catch grooves 36 from the other end portions thereof. That is, in this specification, the state where the projecting portions 54 are positioned within the catch grooves 36 is sometimes described as "the handle part 3 is caught on the female-type connector housing 5".

The thus-structured handle part 3 is mounted onto the hold part 2 with a clearance between the paired plate portions 31 spread. Also, the engagement between the penetration holes 27 and temporarily engaging projections 34 can be removed when, in the connector fitting operation, the temporary engagement removing ribs 56 move into between the side plates 21 and plate portions 31 to thereby increase a clearance between the side plates 21 and plate portions 31.

Next, description is given of a method for fitting the first and second connectors 15 and 14 with each other using the above-mentioned lever mechanism for connector fitting 1 with reference to FIGS. 5 to 10.

Figure 5:
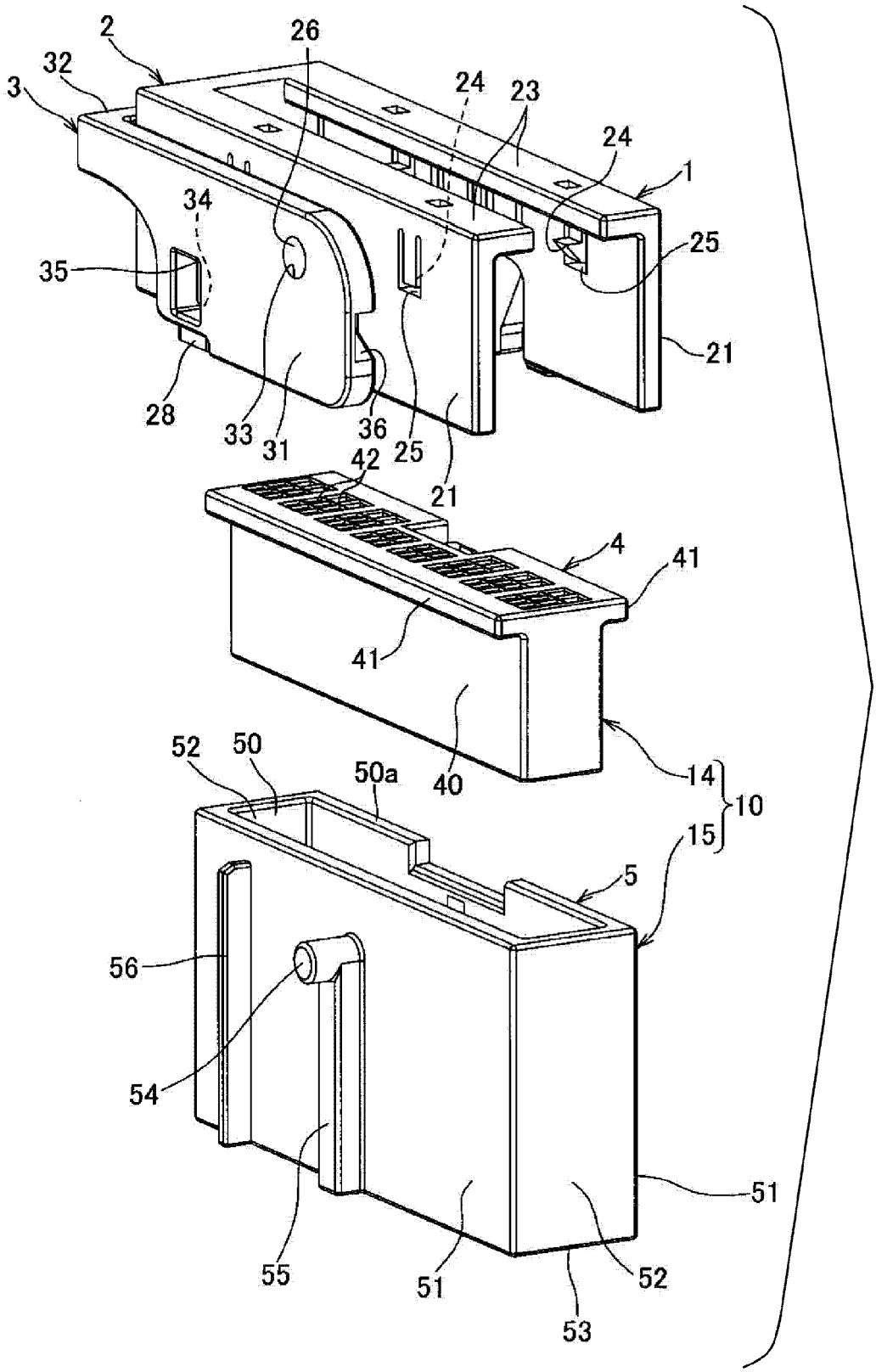
FIG. 5 is an explanatory view to explain a connector fitting method using the lever mechanism for connector fitting shown in FIG. 1, showing a state where the first and second connectors are separated from each other.
Figure 7:
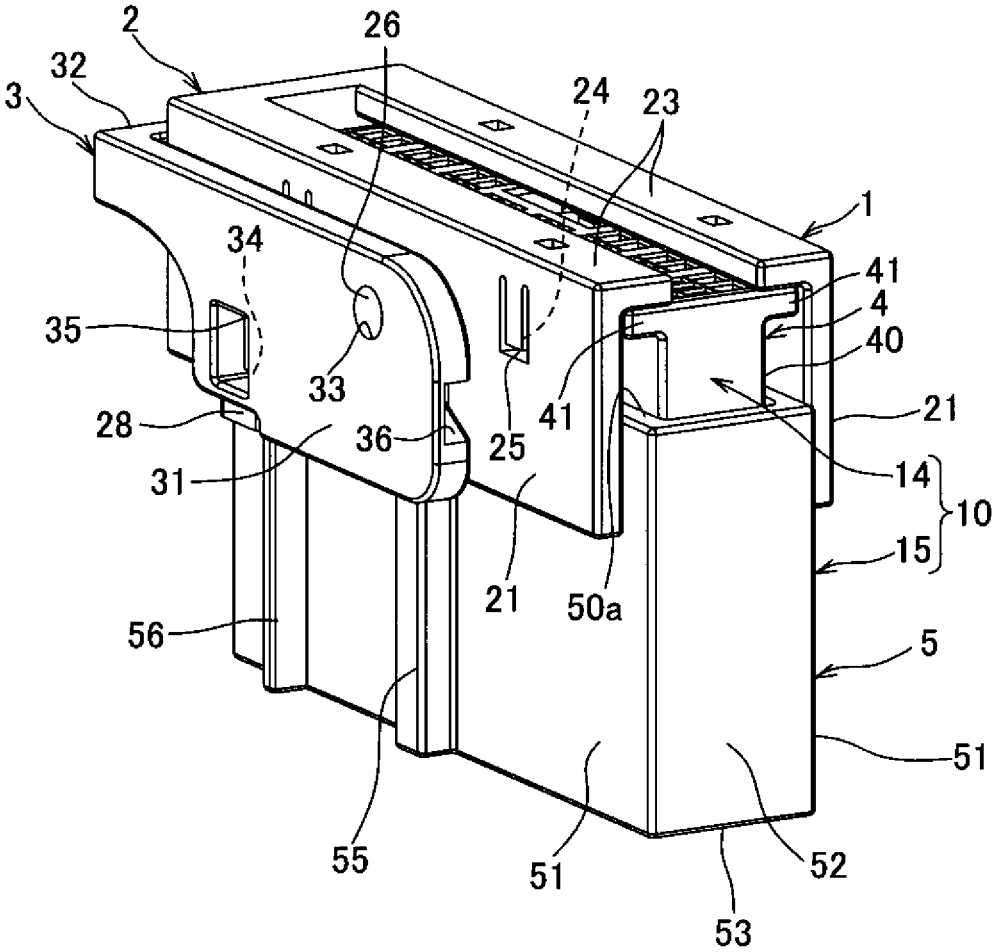
FIG. 7 is an explanatory view to explain a connector fitting method using the lever mechanism for connector fitting shown in FIG. 1, showing a state where the second connector shown in FIG. 6 is in part inserted into the first connector.

As shown in FIG. 5, the temporarily engaging projections 34 are previously engaged into the penetration holes 27. Next, as shown in FIG. 6, the paired flange portions 41 of the connector housing 4 are positioned between the multiple engaging projections 24 and the paired pressure plates 23 to thereby mount the second connector 14 onto the hold part 2 of the lever mechanism for connector fitting 1. And, as shown in FIG. 7, the lower end portions of the connector housing 4 are inserted into the connector housing 5 of the first connector 15 and also the upper end portions of the connector housing 5 are positioned between the paired side plates 21. In this state, the terminal metal members of the first and second connectors 15 and 14 are not yet connected together. Also, when the second connector 14 and lever mechanism for connector fitting 1 are set on the first connector 15 in this manner, the projecting portions 54 move into the catch grooves 36 from its one end portion and, simultaneously, the temporary engagement removing ribs 56 move into between the side plates 21 and plate portions 31, thereby removing the engagement between the penetration holes 27 and temporarily engaging projections 34.

Figure 8:
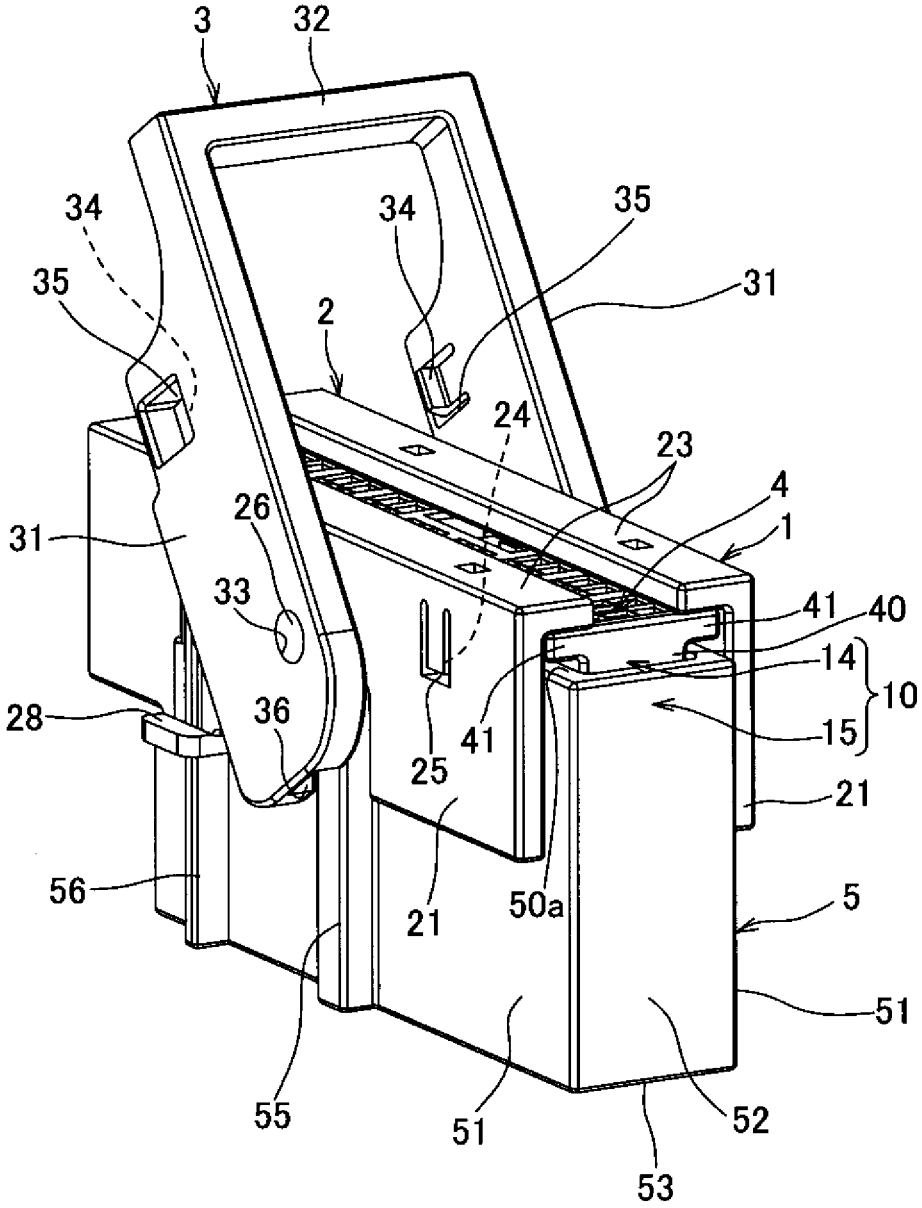
FIG. 8 is an explanatory view to explain a connector fitting method using the lever mechanism for connector fitting shown in FIG. 1, showing a state where the handle part of the lever mechanism for connector fitting shown in FIG. 7 is rotated.
Figure 9:
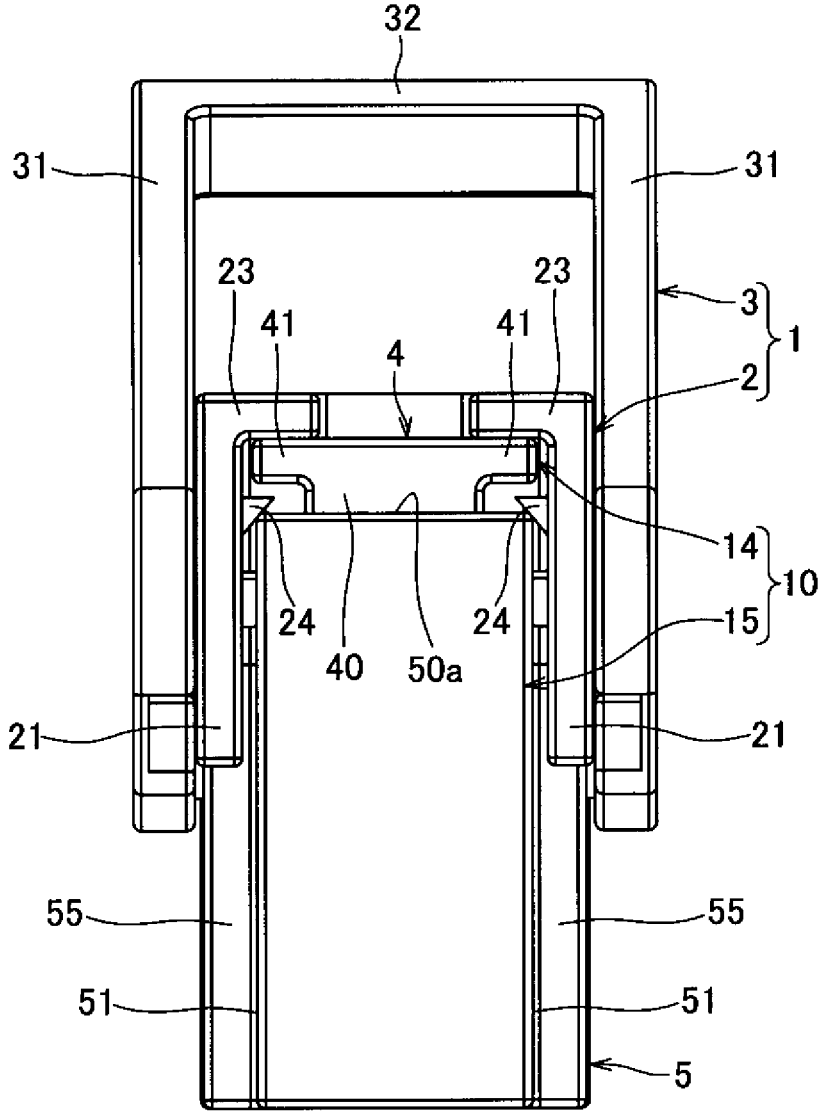
FIG. 9 is a plan view of the lever mechanism for connector fitting and connector shown in FIG. 8.

Next, as shown in FIG. 8, by rotating the handle part 3, the paired pressure plates 23 are driven to press the connector housing 4 toward the connector housing 5, thereby connecting the first and second connectors 15 and 14 with each other. Also, just before the first and second connectors 15 and 14 are fitted, as shown in FIG. 9, the edge portions 50*a* of the connector housing 5 are contacted with the multiple engaging projections 24 from inside, thereby pressing the multiple engaging projections 24 in a direction to part away from the connector housing 4. This causes the multiple engaging projections 24 to retreat from the connector housing 4 side, whereby the holding of the connector housing 4 by the hold part 2 is removed and the hold part 2 is thereby removed from the connector housing 4. After then, the connector housing 4 is pushed further toward the connector housing 5, whereby the first and second connectors 15 and 14 are fitted with each other. Also, simultaneously with the fitting of the first and second connectors 15 and 14, the projecting portions 54 move out of the catch grooves 36 from the other end portions thereof, whereby the lever mechanism for connector fitting 1 is removed from the first and second connectors 15 and 14.

Thus, in this embodiment, since, after the fitting of the first and second connectors 15 and 14, the lever mechanism for connector fitting 1 is automatically removed from the first and second connectors 15 and 14, the lever mechanism for connector fitting 1 can be reused for the fitting operation of the other connector 10. Also, in the case of the connector 10 assembled in such a manner that the first and second connectors 15 and 14 are fitted together by the lever mechanism for connector fitting 1, since, in its completed product state, the lever mechanism for connector fitting 1 is already removed therefrom, the weight and cost of the connector 10 can be reduced by an amount equivalent to the exclusion of the lever mechanism for connector fitting 1.

Also, in this embodiment, the lever mechanism for connector fitting 1 includes a temporarily engaging structure for restricting the position of the handle part 3, that is, the penetration holes 27 and temporarily engaging projections 34, while the first connector 15 includes a temporary engagement removing structure, that is, the temporary engagement removing ribs 56. Thus, simply by placing the second connector 14 and lever mechanism for connector fitting 1 on the first connector 15, the projecting portions 54 can be positioned within the catch grooves 36, and the engagement between the penetration holes 27 and temporarily engaging projections 34 can be removed, thereby being able to facilitate the connector fitting operation.

Here, the above-mentioned embodiment is just a typical embodiment of the invention and thus the invention is not limited to this. That is, the invention can be carried out while it is changed variously without departing from the gist of the invention.

This application is based on the Japanese Patent Application (JPA 2011-134973) filed on Jun. 17, 2011 and thus the contents thereof are incorporated herein for reference.

INDUSTRIAL APPLICABILITY

A lever mechanism for connector fitting and a connector according to the invention can advantageously provide a lever mechanism for connector fitting which, after a first connector and a second connector are fitted with each other, can be removed automatically from the first and second connectors, and a connector in which a first connector and a second connector can be fitted with each other using such lever mechanism for connector fitting.

DESCRIPTION OF REFERENCE NUMERALS

1: Lever mechanism for connector fitting
2: Hold part
3: Handle part
4: Male-type connector housing
5: Female-type connector housing
10: Connector
14: Second connector
15: First connector
21: Side plate
23: Pressure plate
24: Engaging projection
27: Penetration hole
34: Temporarily engaging projection

The invention claimed is:

1. A lever mechanism for connector fitting for connecting together a first connector having a first connector housing and a second connector having a second connector housing, comprising:

a hold part for holding the second connector housing; and, a handle part mounted rotatably on the hold part and catchable on the first connector housing, wherein the hold part includes a pair of side plates for positioning the second connector housing between them, a pressure plate extended from a portion of one of the paired side plates toward the other side plate, and at least one engaging projection provided on an inner surface of one of the side plates so as to be able to advance from such inner surface toward the other side plate and retreat from the other side plate to such inner surface, the engaging projection being used to position a portion of the second connector housing between the pressure plate and the engaging projection itself, whereby, when the handle part is rotated to thereby insert the second connector housing into the first connector housing, the engaging projection retreats from the second connector housing, thereby removing the holding of the second connector housing by the hold part.

2. A lever mechanism for connector fitting according to claim 1, wherein at least one of the side plates of the hold part and the handle part includes a recessed portion or a penetration hole, and the other includes a temporarily engaging projection engageable into the recessed portion or the penetration hole.

3. A connector, comprising: a first connector having a first connector housing; and, a second connector having a second connector housing, the connector being structured such that the second connector housing is inserted into the first connecting housing by the lever mechanism for connector fitting according to claim 1 to thereby fit the first connector and the second connector with each other, wherein the first connector housing includes a first housing main body having an opening and a cylindrical projecting portion provided on an outer surface of the first housing main body and capable of catching the handle part of the lever mechanism for connector fitting, and the second connector housing includes a second cuboid-shaped housing main body and a pair of flange portions respectively projected from a pair of mutually opposed side surfaces of the second housing main body, whereby, in a state where the second connector housing is inserted into the first connector housing, the flange portions of the second connector housing are contacted with an edge portion of the first connector housing as constitutes an opening of the first connector housing.

4. A connector, comprising: a first connector having a first connector housing; and, a second connector having a second connector housing, the connector being structured such that the second connector housing is inserted into the first connecting housing by the lever mechanism for connector fitting according to claim 2 to thereby fit the first connector and the second connector with each other, wherein the first connector housing includes a first housing main body having an opening and a cylindrical projecting portion provided on an outer surface of the first housing main body and capable of catching the handle part of the lever mechanism for connector fitting, and the second connector housing includes a second cuboid-shaped housing main body and a pair of flange portions respectively projected from a pair of mutually opposed side surfaces of the second housing main body, whereby, in a state where the second connector housing is inserted into the first connector housing, the flange portions of the second connector housing are contacted with an edge portion of the first connector housing as constitutes an opening of the first housing main body, and wherein the first housing main body includes on the outer surface thereof a temporary engagement removing rib extending in the fitting direction of the first connector and the second connector, whereby, when the temporary engagement removing rib advances into between the hold part and the handle part, the engagement between the recessed portion or the penetration hole and the temporarily engaging projection can be removed.

5. A connector, comprising: a first connector having a first connector housing; and, a second connector having a second connector housing, the connector being structured such that the second connector housing is inserted into the first connecting housing by the lever mechanism for connector fitting according to claim 2 to thereby fit the first connector and the second connector with each other, wherein the first connector housing includes a first housing main body having an opening and a cylindrical projecting portion provided on an outer surface of the first housing main body and capable of catching the handle part of the lever mechanism for connector fitting, and the second connector housing includes a second cuboid-shaped housing main body and a pair of flange portions respectively projected from a pair of mutually opposed side surfaces of the second housing main body, whereby, in a state where the second connector housing is inserted into the first connector housing, the flange portions of the second connector housing are contacted with an edge portion of the first connector housing as constitutes an opening of the first connector housing.

* * * * *